US005280998A

United States Patent [19]

Miotto et al.

[11] Patent Number: 5,280,998

[45] Date of Patent: Jan. 25, 1994

[54] MECHANICAL DEVICE, PARTICULARLY FOR THE MOVEMENT AND SELECTIVE LOCKING OF A CHAIR

[75] Inventors: Loris Miotto; Beniamino Miotto, both of Roncade, Italy

[73] Assignee: Miotto & Associates International Limited S.r.l., Quinto, Italy

[21] Appl. No.: 843,911

[22] Filed: Feb. 27, 1992

[30] Foreign Application Priority Data

Mar. 1, 1991 [IT] Italy ..... TV91A000028

[51] Int. Cl.[5] ..... A47C 3/00

[52] U.S. Cl. ..... 297/302; 297/344.19

[58] Field of Search ..... 297/302, 304, 301, 326, 297/328, 345

[56] References Cited

U.S. PATENT DOCUMENTS

| | | | |
|---|---|---|---|
| 555,029 | 2/1896 | Watkins . | |
| 2,249,828 | 8/1938 | Herold . | |
| 2,991,125 | 7/1961 | Lie . | |
| 3,131,904 | 5/1964 | Lie . | |
| 3,480,249 | 11/1969 | Lie . | |
| 3,592,433 | 7/1971 | Fuhrman . | |
| 3,659,819 | 5/1972 | Wolters . | |
| 3,669,398 | 6/1972 | Robinson . | |
| 3,813,073 | 5/1974 | Mohr et al. . | |
| 3,868,144 | 2/1975 | Lie . | |
| 4,185,803 | 1/1980 | Kalvatn . | |
| 4,295,626 | 10/1981 | Large . | |
| 4,384,741 | 5/1983 | Flum et al. | 297/304 |
| 4,431,157 | 2/1984 | Arild . | |
| 4,555,085 | 11/1985 | Bauer et al. | 297/304 X |
| 4,575,151 | 3/1986 | Edstrom . | |
| 4,629,249 | 12/1986 | Yamaguchi . | |
| 4,718,726 | 1/1988 | Estkowski et al. . | |
| 4,743,065 | 5/1988 | Meiller et al. . | |
| 4,744,600 | 5/1988 | Inoue . | |
| 4,747,640 | 5/1988 | Locher . | |
| 4,832,402 | 5/1989 | Zund | 297/304 X |
| 4,892,354 | 1/1990 | Estkowski et al. . | |
| 4,986,601 | 1/1991 | Inoue . | |
| 5,018,787 | 5/1991 | Estkowski et al. . | |
| 5,029,940 | 7/1991 | Golynsky et al. | 297/302 X |

FOREIGN PATENT DOCUMENTS

| | | |
|---|---|---|
| 179933 | 10/1984 | European Pat. Off. . |
| 0198056 | 10/1985 | European Pat. Off. . |
| 0392984 | 10/1990 | European Pat. Off. . |
| 3724605 | 2/1989 | Fed. Rep. of Germany . |
| 2075176 | 8/1971 | France . |

*Primary Examiner*—Philip C. Kannan

*Attorney, Agent, or Firm*—Lee, Mann, Smith, McWilliams, Sweeney & Ohlson

[57] ABSTRACT

A mechanical device for the movement and selective locking of a chair and for controlling a gas piston. The mechanical device comprises a first arm and a second arm spaced apart from the first arm which are connectable to the chair. A pivoting pin extends between and is connected to the first arm and the second arm. A boxlike element including a first and second aperture is pivotally connected to the pivoting pin such that the arms may selectively pivot with respect to the boxlike element. A molding box is connected to the pivoting pin and a resilient member engages the molding box and the boxlike element. A shaft extends through the first and second apertures in the boxlike element and is selectively positionable therein to selectively lock the position of the molding box relative to the boxlike element. Rotation of the shaft controls the operation of the gas piston.

17 Claims, 3 Drawing Sheets

MECHANICAL DEVICE, PARTICULARLY FOR THE MOVEMENT AND SELECTIVE LOCKING OF A CHAIR

SUMMARY

The present application is for a mechanical device, particularly usable for the movement and selective locking of a chair.

This device comprises a pair of arms to be fastened to the chair and consists of a swivel boxlike element associated with a pivoting pin integral with said pair of arms, which contains a molding box integral with said pin.

The molding box interacts both with means of resilient opposition to said boxlike element and with a separate means for the selective locking of the position of the chair with regard to the boxlike element and for the control for a gas piston.

This mechanical device makes it possible to achieve an optimal adjustment of the chair by directly acting on the selective locking means which interacts with the molding box.

DESCRIPTION

The present application is for a mechanical device particularly usable for the movement and the selective locking of a chair.

Today there are well-known mechanical devices, which are used to adjust the tilt of a chair.

One well-known type consists of a chair whose seat is fixed with regard to the column projecting from a swivel base, with the possibility of tilting the back in relation to the seat.

This type, however, presents an annoying drawback whenever the user shifts his position on the seat as a result of the natural stretching of the user's body.

As a partial solution to this drawback, it is common to make a seat and back connected to each other so that a tilt of the back is accompanied by a shift or tilt of the seat: therefore, below the seat there is usually present a first lever used to control a gas piston that lifts the seat to a greater or lesser degree and another lever used to operate a mechanism installed for tilting to a greater or less degree.

This well-known type presents some drawbacks: the use of two levers forces the user to seek specifically the one he wants with the result that many times the wrong control is used requiring the user to go back to the former condition.

Furthermore, a certain amount of dexterity is required from the user who must seek out the two levers without being able to see them.

Lastly, the mechanisms that interact with the two levers are of necessity complex and therefore their construction is costly.

The main task of the object of the present application is therefore to eliminate the above-mentioned drawbacks in well-known types by devising a mechanical device that, once it has been attached to a chair, will make it possible to attain an optimal adjustment in the positioning of said chair by performing operations that are quick and easy for the user.

Within the scope of the aforementioned goal, another important purpose is to embody a discovery that will make it possible for the user to obtain these adjustments selectively and, therefore, according to specific requirements.

Yet another important purpose is to embody a discovery that will be structurally simple and easy to manufacture.

Not the least purpose is to embody a discovery that will prove reliable and safe to use with rather limited costs to increase its application even on chairs whose overall value is not high.

The aforementioned task and purposes, as well as others that will appear more clearly below, are found in a mechanical device, particularly for the movement and selective locking of a chair, comprising a pair of arms to be fastened to said chair, characterized by the fact that it presents a boxlike element associated in a swiveling fashion with a pivoting pin integral with the aforesaid pair of arms containing a molding box integral with said pin which interacts with means of resilient opposition with the aforesaid boxlike element and with a separate means for selectively locking the position of the aforesaid chair in relation to the boxlike element and for the gas-piston control.

Further features and advantages of the discovery will appear more evident from the detailed description of a particular but not exclusive embodiment, illustrated by way of an illustration whose purpose is not to limit the invention in the attached drawings wherein.

Figure 3:
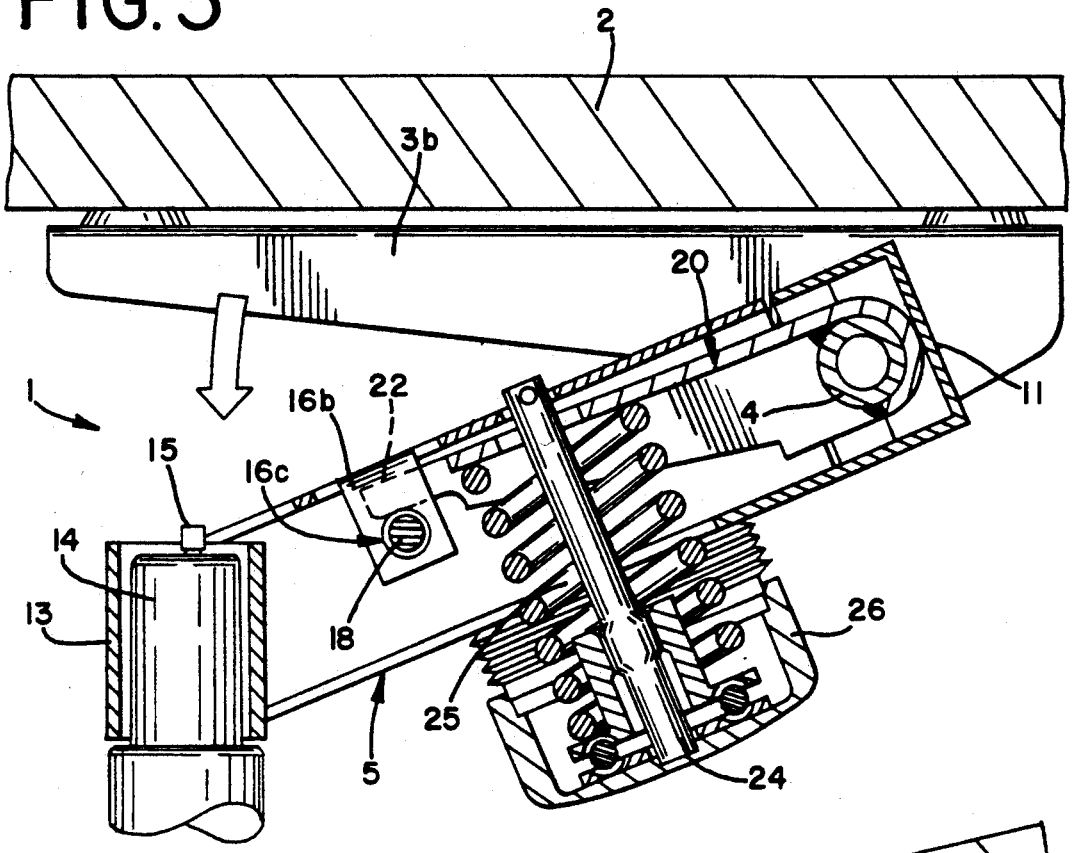

FIG. 3 shows the device in the non-tilting condition for the chair with the shaft 18 inserted in the third hole 16*c* made on the tab 16*b;*

Figure 4:
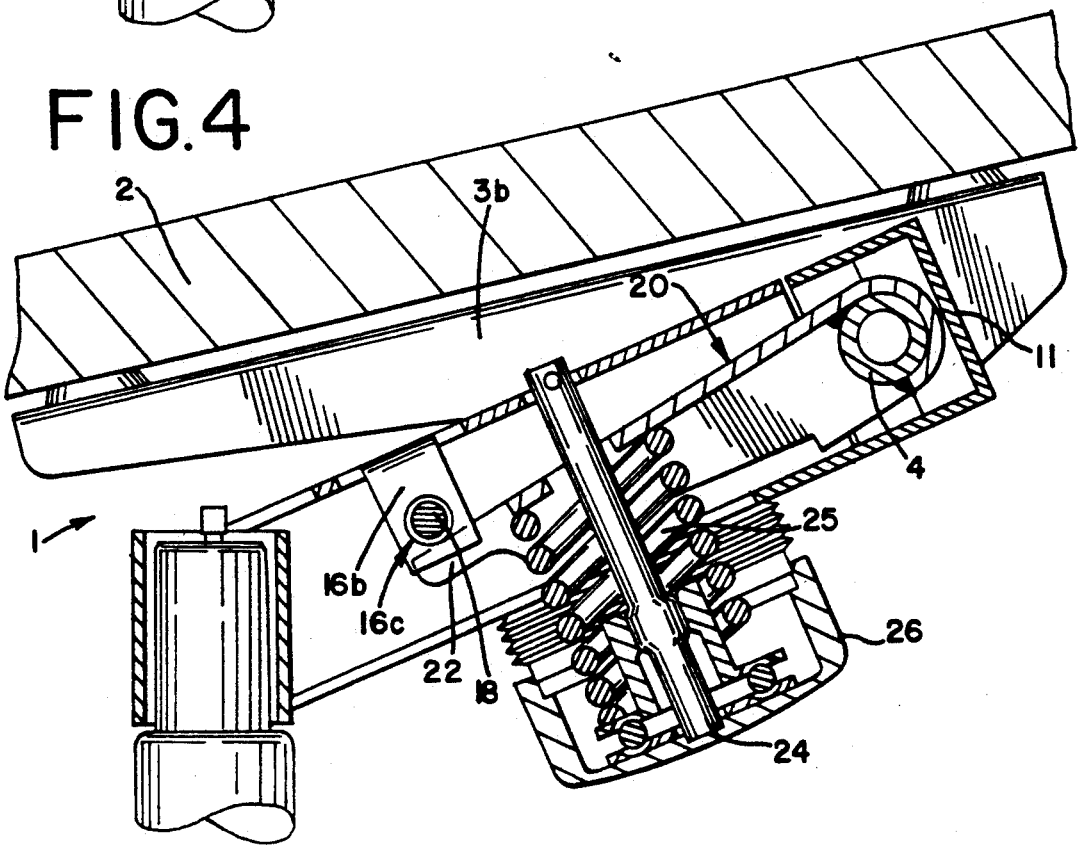

FIG. 4 shows the device in the condition of possible tilting for the chair if the shaft 18 is withdrawn from the third hole 16*c*.

With regard to the aforementioned figures, the mechanical device, shown in its entirety with number 1, proves particularly usable for the movement and selective locking of a chair 2 attachable at the upper part to a pair of arms 3*a* and 3*b* integrally connected transversally and at one end to a pivoting pin 4.

A boxlike element 5 is attached in a swivel fashion to said pivoting pin 4 in the vicinity of the ends integral with the pair of arms 3*a* and 3*b*.

From this boxlike element, which from above has a triangular shape, there project laterally a pair of first appendages 6*a* and 6*b* equipped with predrilled first holes 7*a* and 7*b* for the fastening by means of the first and second screws, indicated with numbers 8*a* and 8*b*, and two pairs of sleeves 9*a*, 9*b* and 10*a*, 10*b*.

Alternatively, the connection between both pairs of sleeves may be done by gluing them or by means of a recess or other equivalent solution.

These last items are preferably made of self-lubricating plastic material, such as nylon, and can be closed up between each other by means of the first and second screws in order to allow the swivel connection to the pivoting pin 4 of the boxlike element 5.

Ideally a U-channel 11, which can be temporarily associated at the back with the aforesaid two pairs of sleeves in order to conceal them, may be provided for.

The boxlike element presents in connection with its vertex a conical bushing 13, fitted for receiving the end of a column 14, presenting a control 15 for the gas supply.

The boxlike element 5 presents laterally a second hole 16*a* and, in connection with a predisposed tab 16*b*, projecting internally, a third hole 16*c;* these second and third holes present the same axis transversally to the boxlike element 5 in relation to them, which can be positioned, and with the end 17 of an accessible shaft 18 passing through to the other end to the user.

In the interspace present between the aforesaid second and third holes there projects, from the aforesaid end 17 of the aforesaid shaft 18, a second appendage 19 able to interact, by turning the aforesaid shaft, with the aforesaid control 15 for the gas supply.

Furthermore, there is a molding box 20, with an essentially trapezoidal shape, whose large end 21 is linked to the aforesaid pivoting pin 4, that can be associated with said boxlike element 5.

This molding box 20 presents a longitudinal extension lower than that of the aforesaid boxlike element 5, which extension presents laterally a third appendage 22 which extends beyond the smaller end 23.

This third appendage 22 is located in the interspace present between the planes in which the tab **16*b*** and the adjacent lateral surface of the boxlike element lie.

Below the molding box 20 there are means of resilient opposition comprising a small pin 24-around which there is a spring 25 to which it is associated and a knob 26 at one end-which passes through the aforesaid molding box 20 and the aforesaid boxlike element 4 at the fourth and fifth holes made therein and marked with numbers 27 and 28.

The shaft 18 is a means which is able to permit the selective locking of the position of the chair with regard to the boxlike element and which is for operating the gas control.

The use of the mechanical device 1 is as follows: Once the user has seated himself on the chair, he may easily modify its disposition, predetermining both its height above the floor and its tilt, doing so by merely acting on the single shaft 18, which projects laterally from the mechanical device.

Ideally, the action of the user on said shaft 18 may be divided into two phases, depending on whether he wants to act on the locking or the activation of the tilt or on the gas-piston control.

Figure 1:
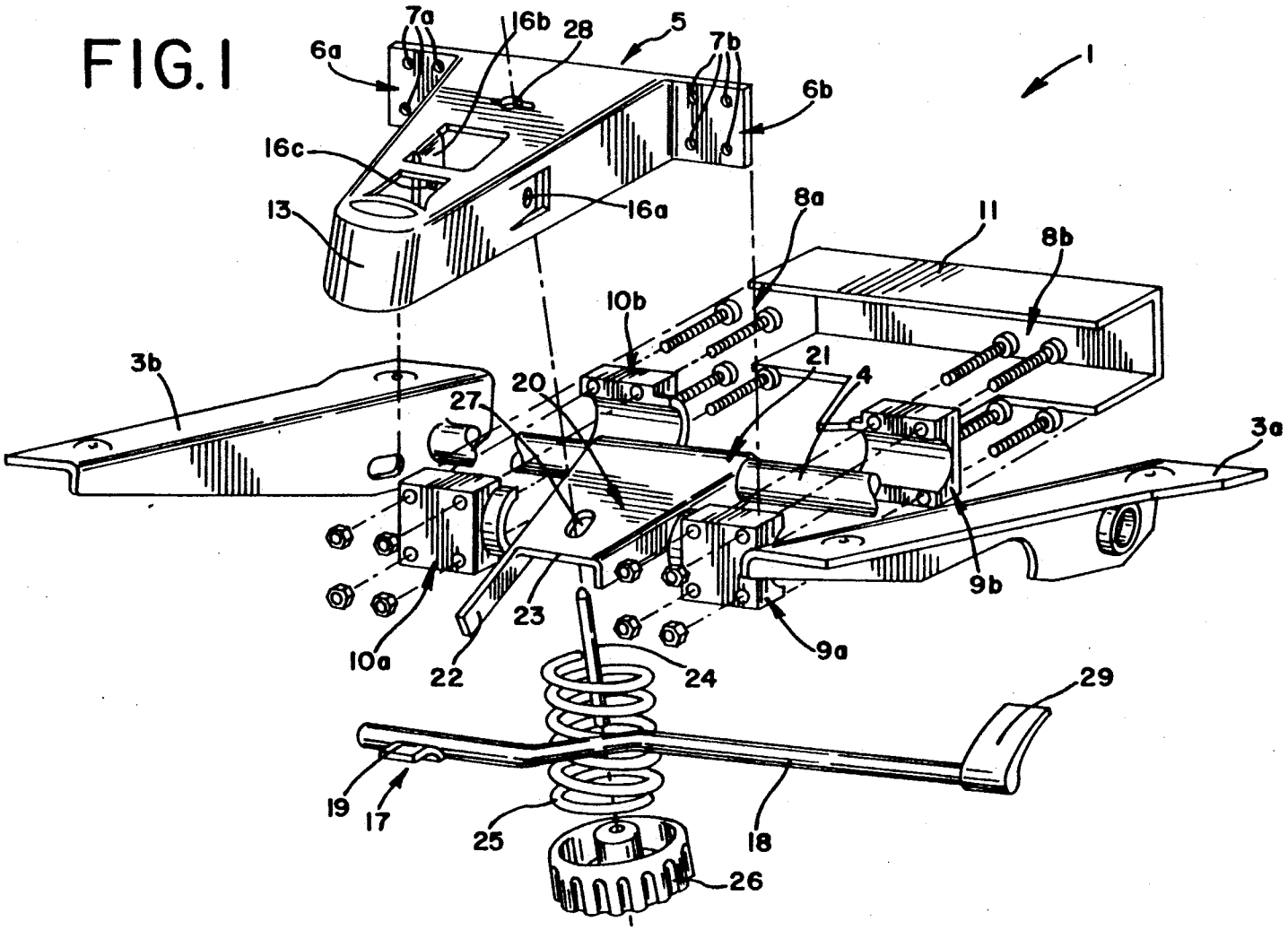
FIG. 1 shows the device in an exploded view.
Figure 2:
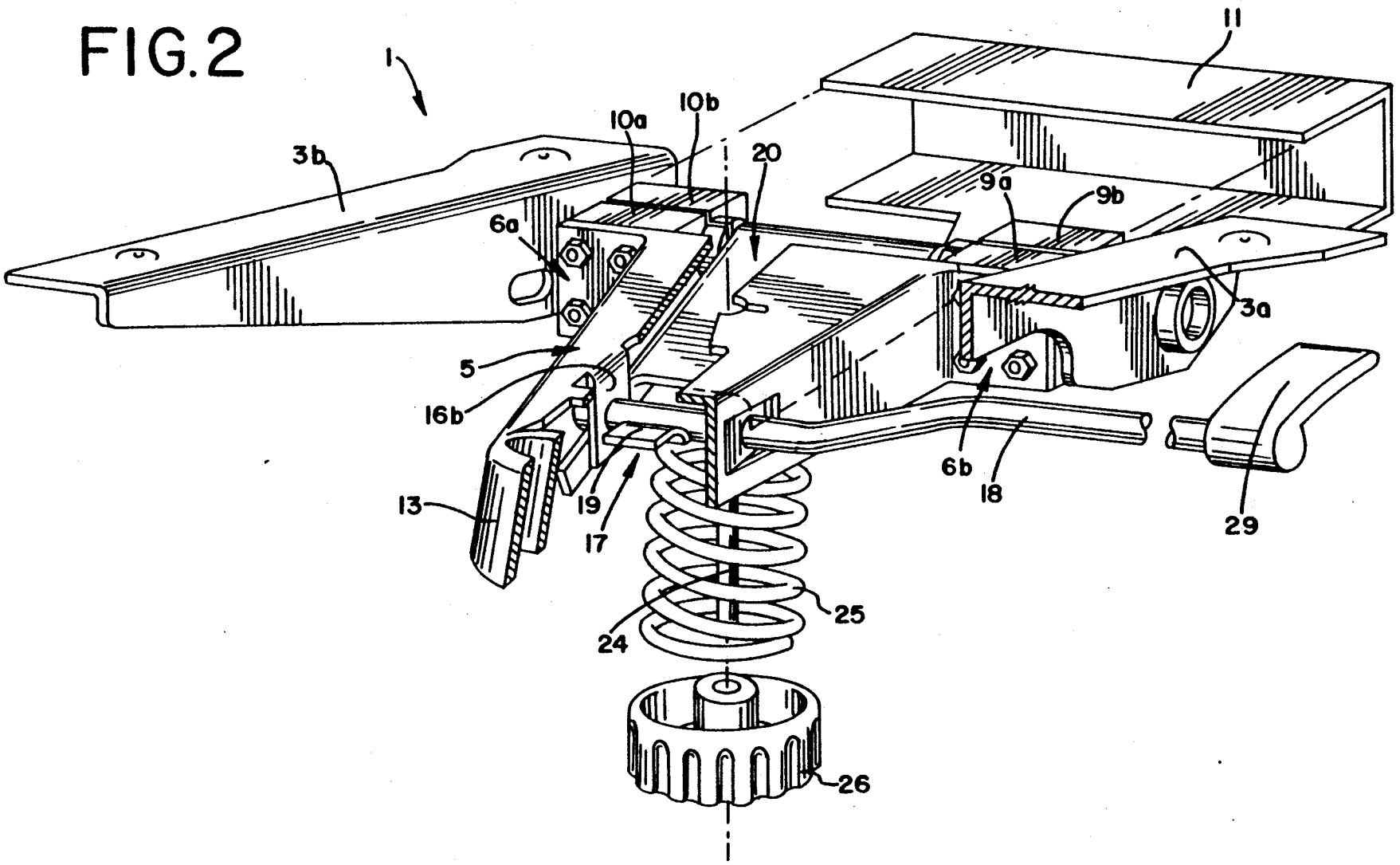
FIG. 2 shows the device in a three-quarters partially cross-sectional view.

Starting with the condition shown in FIG. 2, wherein the shaft 18 engages either the second hole **16*a* or the third hole 16*c* and the third appendage 22 of the molding box 20 presses against the far end of the aforesaid shaft 18 from below, the chair is permitted to tilt against the spring 25**.

Grasping the shaft 18 and pulling outward, the user can withdraw said shaft and free its far end from the third hole **16*c***; by so doing, the condition of free tilting is obtained for the chair.

If the user reinserts the end of the shaft 18 in the third hole **16*c*, two different situations can be obtained: if the third appendage 22 is lodged between the upper surface of the molding box 20 and the end of the shaft 18, as illustrated in FIG. 3**, the user may remain seated in a working position since it is not possible for the chair to revolve around the pin.

If, instead, the end of the shaft 18 is lodged between the upper surface of the molding box 20 and the third appendage 22, as illustrated in FIG. 4, the user may remain seated in a relaxed position since the chair is slightly inclined backwards.

If, instead, the user wants to operate the gas-piston control 15, he should grasp the end fin 29 of the shaft 18 pulling it upward: by so doing, the second appendage 19 squeezes the aforesaid control 15 obtaining the gas supply and thereby varying the height position of the chair.

These operations may, furthermore, be done "blindly," in view of the extreme operating simplicity and the accessibility of the shaft which, since there is only one, is easy for the user to locate.

It is thus observed how the discovery had accomplished the pre-established task and the purposes, there being obtained a mechanical device that makes it possible to achieve an optimal positioning of the chair by means of directly acting on the only locking means, consisting of the shaft 18 which interacts with the molding box 20.

Of course, the discovery may undergo numerous modifications and variations, all of which fall within the scope of the same inventive idea.

Thus, both the materials and the characteristics of the individual components used may be the most consistent with the specific requirements.

What is claimed is:

1. A mechanical device, particularly for the movement and selective locking of a chair, comprising a pair of arms to be fastened to the chair, a pivoting pin connected to and extending between said pair of arms, a boxlike element including a pair of first appendages projecting laterally therefrom and a pair of sleeves connected to said appendages, said sleeves attaching said boxlike element in a swiveling fashion to said projecting pin, a molding box connected to said pin, means for resilient opposition engaging said boxlike element and said molding box, and means attached to said boxlike element for the selective locking of the position of the chair with regard to said boxlike element and for the control of a gas piston.

2. The mechanical device according to claim 1 wherein said first appendages include first holes for fastening said sleeves to said first appendages, said sleeves being made of a self-lubricating plastic material.

3. The mechanical device according to claim 2 including a conical bushing fashioned to receive the end of a column presenting a control for the gas supply, a second hole and, in relation to a predisposed tab projecting internally a third hole, said second and third holes present the same axis transverse to said boxlike element; and a shaft passing through said second and third holes, said shaft including a first end which can be positioned relative to said second and third holes, which shaft is accessible at the other end by the user, said shaft comprising said means for selective locking of the position of the chair with regard to said boxlike element and for the gas-piston control.

4. The mechanical device according to claim 3, characterized by the fact that in the interspace present between said second and third holes, there projects from said shaft a second appendage.

5. The mechanical device of claim 4, characterized by the fact that said molding box has an essentially trapezoidal shape including a larger end and a smaller end, with the larger end linked to said pivoting pin; said molding box presenting a longitudinal extension below that of said boxlike element, with said molding box presenting laterally a third appendage which extends beyond the smaller end.

6. The mechanical device according to claim 5, characterized by the fact that said third appendage is positioned in the interspace present between the planes in which lie said tab and the adjacent lateral surface of said boxlike element.

7. The mechanical device according to claim 6 wherein said molding box includes a fourth hole therein and said boxlike element includes a fifth hole therein, and said means for resilient opposition comprises a small pin, around which there is associated a spring and to which at one end there is a knob, said pin passing through said fourth hole in said molding box and said fifth hole in said boxlike element.

8. The mechanical device according to claim 7, characterized by the fact that the first end of said shaft inside said boxlike element can be inserted in said third hole positioning said third appendage above or below the shaft, which shaft makes it possible to tilt said chair after said first end has been withdrawn from said third hole.

9. The mechanical device according to claim 2, including a U-channel which can be temporarily positioned over said sleeves to conceal them.

10. A mechanical device for the movement and selective locking of a chair and for controlling a gas piston, said device comprising a first arm and a second arm spaced apart from said first arm, said arms being connectable to the chair, a pivoting pin extending between and connected to said first arm and said second arm, a boxlike element including a first aperture and a second aperture pivotally connected to said pivoting pin such that said arms may selectively pivot with respect to said boxlike element, a molding box connected to said pivoting pin, means for resilient opposition acting against said molding box and said boxlike element, and means for the selective locking of the position of said molding box relative to said boxlike element and for controlling the operation of the gas piston, said selective locking means comprising a shaft selectively positionable within said first and second apertures in said boxlike element.

11. The mechanical device of claim 10 wherein said boxlike element includes a pair of laterally projecting first appendages and a pair of sleeves connected to each said appendage, said sleeves providing a pivoting connection between said boxlike element and said pivot pin.

12. The mechanical device of claim 11 additionally including a generally U-shaped channel adapted to be positioned over said sleeves.

13. The mechanical device of claim 10 wherein said shaft includes a first appendage projecting from said shaft, said first appendage being located between said first and second apertures in said boxlike element.

14. The mechanical device of claim 13 wherein said molding box includes a first end connected to said pivot pin and a second end, said second end including a second appendage which extends from said second end.

15. The mechanical device of claim 14 wherein said boxlike element includes a downwardly extending tab in which said first aperture is located, and wherein said second appendage of said molding box is located in an interspace between said tab and an adjacent lateral surface of said molding box.

16. The mechanical device of claim 15 wherein said shaft is axially moveable such that said shaft may be selectively extending into said interspace such that said second appendage may be positioned above or below said shaft as desired, thereby inhibiting the pivoting of said arms, and such that said shaft may be selectively withdrawn from said interspace thereby allowing said arms to pivot.

17. The mechanical device of claim 10 wherein said means for resilient opposition comprises a spring.

* * * * *